US006250280B1

(12) United States Patent
Miller

(10) Patent No.: US 6,250,280 B1
(45) Date of Patent: Jun. 26, 2001

(54) ROTARY DRIVE ENGINE

(76) Inventor: Roger Wayne Miller, 5510 SW. 96th Ave., Miami, FL (US) 33165

( * ) Notice: Subject to any disclaimer, the term of this patent is extended or adjusted under 35 U.S.C. 154(b) by 0 days.

(21) Appl. No.: 09/347,561

(22) Filed: Jul. 6, 1999

(51) Int. Cl.[7] ..... F02B 53/00
(52) U.S. Cl. ..... 123/243; 418/264
(58) Field of Search ..... 123/243; 418/261, 418/264

(56) References Cited

U.S. PATENT DOCUMENTS

| | | | | |
|---|---|---|---|---|
| 1,986,556 | | 1/1935 | Carroll . | |
| 2,179,401 | * | 11/1939 | Chkliar | 418/264 |
| 2,864,346 | * | 12/1958 | Taylor | 123/243 |
| 3,301,233 | | 1/1967 | Dotto et al. . | |
| 3,578,889 | | 5/1971 | Dagne et al. . | |
| 3,637,332 | | 1/1972 | McAnally, III . | |
| 3,863,610 | | 2/1975 | Spinnett . | |
| 3,873,253 | | 3/1975 | Eickmann . | |
| 4,353,337 | * | 10/1982 | Rosaen | 123/243 |
| 5,277,158 | * | 1/1994 | Pangman | 123/243 |
| 5,816,203 | | 10/1998 | Muth . | |

FOREIGN PATENT DOCUMENTS

| | | | | |
|---|---|---|---|---|
| 1084004 | * | 6/1954 | (FR) | 123/243 |

* cited by examiner

*Primary Examiner*—Michael Koczo
(74) *Attorney, Agent, or Firm*—Malloy & Malloy, P.A.

(57) ABSTRACT

A rotary engine including a drive element rotatably disposed within an open interior of a drive chamber, the drive chamber having an interior wall structure which defines the open interior including a fuel intake region, a combustion region, an exhaust region, and a fluid intake region therein. The engine further includes a plurality of combustion chambers disposed about a periphery of the drive element and movable with the drive element relative to the drive chamber. Further, the combustion chambers are sized in accordance with a relative spacing between the drive element and the interior wall structure, the interior wall structure being defined so that the combustion chambers decrease in size as they rotate through the fuel intake region, thereby compressing a fuel contained in the combustion chambers, increase in size as they rotate through the combustion region, thereby facilitating maximum expansion of combusted fuel in the combustion chambers, decrease in size as they rotate through the exhaust region, thereby maximizing an evacuation of exhaust fluids from the combustion chambers, and increase in size as they rotate through the fluid intake region, thereby maximum an intake of fluid into the combustion chambers. A plurality of fin elements are provided to variably extend from the drive element in accordance with the contour of the interior wall structure and define substantially fluid impervious leading and trailing ends of each combustion chamber.

48 Claims, 3 Drawing Sheets

ROTARY DRIVE ENGINE

BACKGROUND OF THE INVENTION

1. Field of the Invention

The present invention relates to a rotary drive engine structured to provide a continuous energy output, maximize fuel combustion efficiency, minimize fuel waste, and minimize the expulsion of unburned hydrocarbons, in a system that is mechanically effective and durable for extended periods of use.

2. Description of the Related Art

The general concept of rotary type engines, wherein fuel combustion and power generation is continuously taking place, has been an attractive and often sought concept in the field of drive structures. Indeed, because of the constant output of energy that can be generated by these rotary type engines, they are naturally quite popular in a variety of industries, such as for providing driving means for tools, machines, and other types of machinery that require uniform and constant energy outputs in order to be efficiently actuated. Still, however, existing designs of rotary type engines tend to be generally inefficient, often wasting unburned fuel, typically do not provide a clean and efficient burn as compared with conventional piston type engines, and are often quite complex, including a multitude of internal parts, thereby making such designs mechanically impractical.

For example, a problem often encountered with existing rotary engine designs is the inability of those engines to maintain an integral seal and to fully evacuate expended and/or burned exhaust gases. As a result, when a new combustion cycle begins, the capacity for new fuel intake, and accordingly combustion, is reduced, and the fuel introduced is contaminated by the remnant gases. Moreover, because of the contaminated nature of the fuel, as well as due to the general configuration of the combustion chamber, not all of the fuel is used, resulting in the expulsion of unburned, generally environmentally harmful, hydrocarbons from the engine, a reduced power output efficiency, and a reduced fuel consumption efficiency.

As a result, there is a substantial need in the art for an effective and efficient rotary type engine which has a mechanically sound design that is minimally susceptible to malfunction and efficiency loses. Further, such an improved rotary type engine should maximize the effectiveness of each combustion "explosion" by taking advantage of a maximum energy expansion and by providing a maximum purity and combustibility of the fuel mixture.

SUMMARY OF THE INVENTION

The present invention relates to a rotary engine, the rotary engine including at least one drive element and at least one drive chamber. The drive chamber includes an interior wall structure that at least partially defines an open interior area wherein the drive element may be disposed. In particular, the drive element is rotatably disposed within the open interior of the drive chamber about a preferred fixed axis.

Defined about a periphery of the drive element are a plurality of combustion chambers. The combustion chambers are preferably defined relative to a specific combustion segment of the periphery of the drive element. As a result, upon rotation of the drive element, the combustion chambers correspondingly rotate therewith relative to the interior wall structure of the drive chamber. Moreover, the combustion chambers are at least partially sized in accordance with a relative spacing between the periphery of the drive element a corresponding confronting portion of the interior wall structure of the drive chamber, with one or more fin elements being utilized to defined the leading and trailing ends of the combustion chambers.

The open interior of the drive chamber preferably includes at least a fluid intake region, a fuel intake region, a combustion region, and an exhaust region generally defined therein. Moreover, these regions are preferably sequentially disposed, extend into one another and may even overlap. Accordingly, as the combustion chambers rotate within the open interior of the drive chamber in response to the rotation of the drive element, the combustion chambers rotate into, through, and out of the various regions of the open interior of the drive chamber.

Along these lines, the combustion chambers are preferably structured to be variably sized. In the illustrated preferred embodiment, as the combustion chambers are at least partially sized in accordance with the relative spacing between the periphery of the drive element and the interior wall structure of the drive chamber, the size of the individual combustion chambers vary as that relative spacing changes during rotation of the drive element. For example, the interior wall structure of the illustrated embodiment is preferably configured such that at certain portions thereof, the confronting segments of the drive element are relatively close, while after rotation of those segments into confronting relation with other portions of the interior wall structure, the relative spacing is relatively larger.

In the preferred embodiment, the interior wall structure of the drive chamber is configured such that a relatively close spacing is achieved at least partially at the fuel intake region. As a result, the size of correspondingly disposed ones of the combustion chambers will at least temporarily decrease as the combustion chambers rotate through the fuel intake region. This decreasing size in turn functions to generally compress a fuel mixture that has been introduced and is contained within those combustion chambers, thereby increasing its energy potential and concentrating the fuel mixture at an ignition point.

Additionally, preferably as a result of an asymmetrical contour of the interior wall structure of the drive chamber, the interior wall structure is also configured such that the size of correspondingly disposed combustion chambers will at least temporarily increase as the combustion chambers rotate through the combustion region. For example, although a relatively small size of the combustion chambers may be exhibited at a beginning of what is termed the combustion region, an at least temporary increase in the size of the combustion chambers through that combustion region is preferred, thereby facilitating a maximum expansion of the combusted fuel within the combustion chambers, and utilizing the energy that results from the expansion of combusted fluids to its maximum potential for rotating the drive element. Preferably it is at some point within the combustion region that the fuel, and preferably air, mixture contained within the combustion chambers are ignited by at least one combustion ignitor, the explosion and expansion of gases that results from the ignition causing in the continuous driving of the drive element.

The illustrated embodiment further includes a configuration of the interior wall structure of the drive chamber wherein the relative spacing between the interior wall structure and the periphery of the drive element at least temporarily decreases, thereby reducing the size of the combustion chambers as they rotate through the exhaust region. For example, once combustion has generally been completed, the exhaust gases from the combustion process are generally contained in the combustion chamber. Naturally, it is preferred that these exhaust gases be evacuated from the combustion chambers. As a result, by at a least temporarily decreasing the size of the combustion chambers as they rotate through the exhaust region, those exhaust gases are essentially urged from the combustion chambers, such as through an exhaust port, and the evacuation of the exhaust gases is maximized. Once the combustion chambers have been substantially evacuated, however, they will preferably rotate into and through the fluid intake region. It is in the fluid intake region wherein a fluid, preferably air which will mix with the fuel to aid the combustion process, is introduced into the individual combustion chambers. As a result, the interior wall structure of the drive chamber is preferably configured such that the size of the combustion chambers passing through the fluid intake region at least temporarily increase. As a result, a maximum intake of the fluid into the combustion chambers can essentially be achieved, with minimal risk of contamination by the exhaust gases.

Also in the illustrated embodiment, the fin elements variably extend radially from the drive element, thereby maintaining an enclosing integrity of the combustion chambers, even as the interior wall structure of the drive chamber and the periphery of the drive element become variably spaced from one another. In this regard, a contact edge of each of the fin elements is structured to be disposed and maintained in closely spaced, minimally fluid impervious relation with the interior wall structure of the drive chamber as the fin elements rotate therein with the drive element. As a result, the fluids within each combustion chamber are effectively contained after introduction into the system, during combustion, and until evacuated from the system.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the Figures, the present invention is directed towards a rotary engine, generally indicated as 10. The rotary engine 10 is structured for use in a variety of machines, vehicles and devices so as to provide a continuous power output. As a result, depending upon the ultimate application to which the rotary engine 10 will be put, the overall size and dimension of the rotary engine 10, including the specific material composition thereof can vary. For example, for purposes of clarity the figures are primarily presented as plan views of the rotary engine 10, a desired depth of the rotary engine generally being a factor of its desired capacity such that virtually any depth desired could be utilized.

Figure 1:
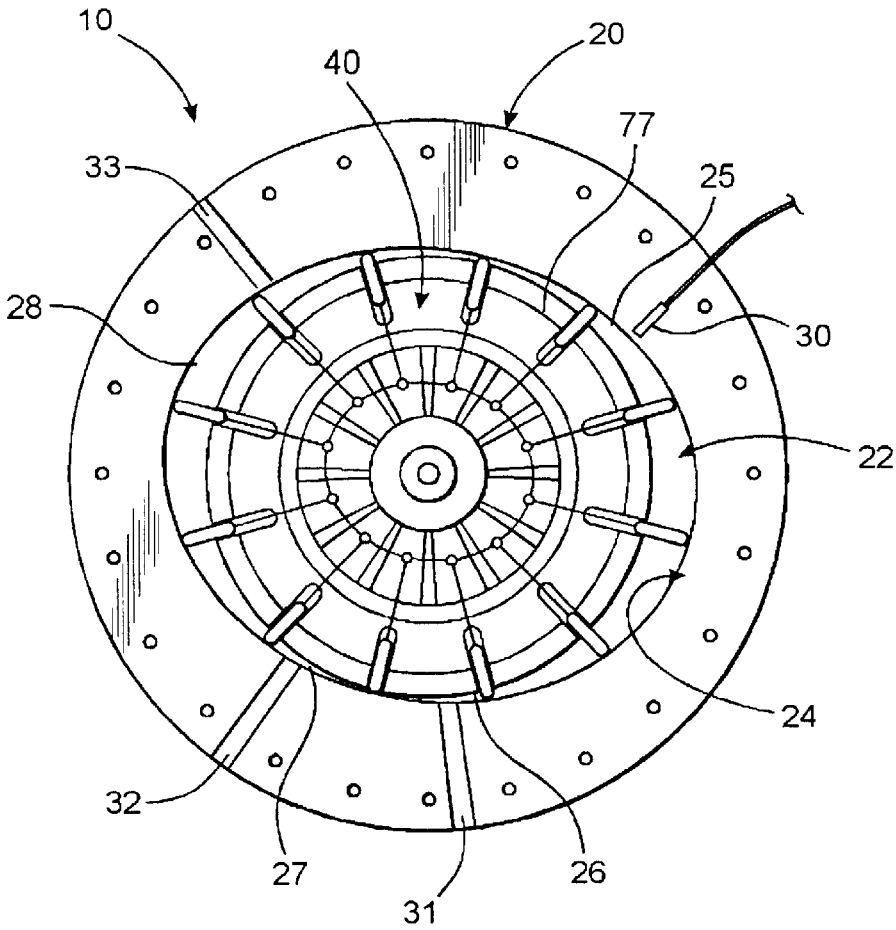
FIG. 1 is a side, interior plan view of an embodiment of the rotary engine of the present invention in an operative configuration.
Figures 4, 5:
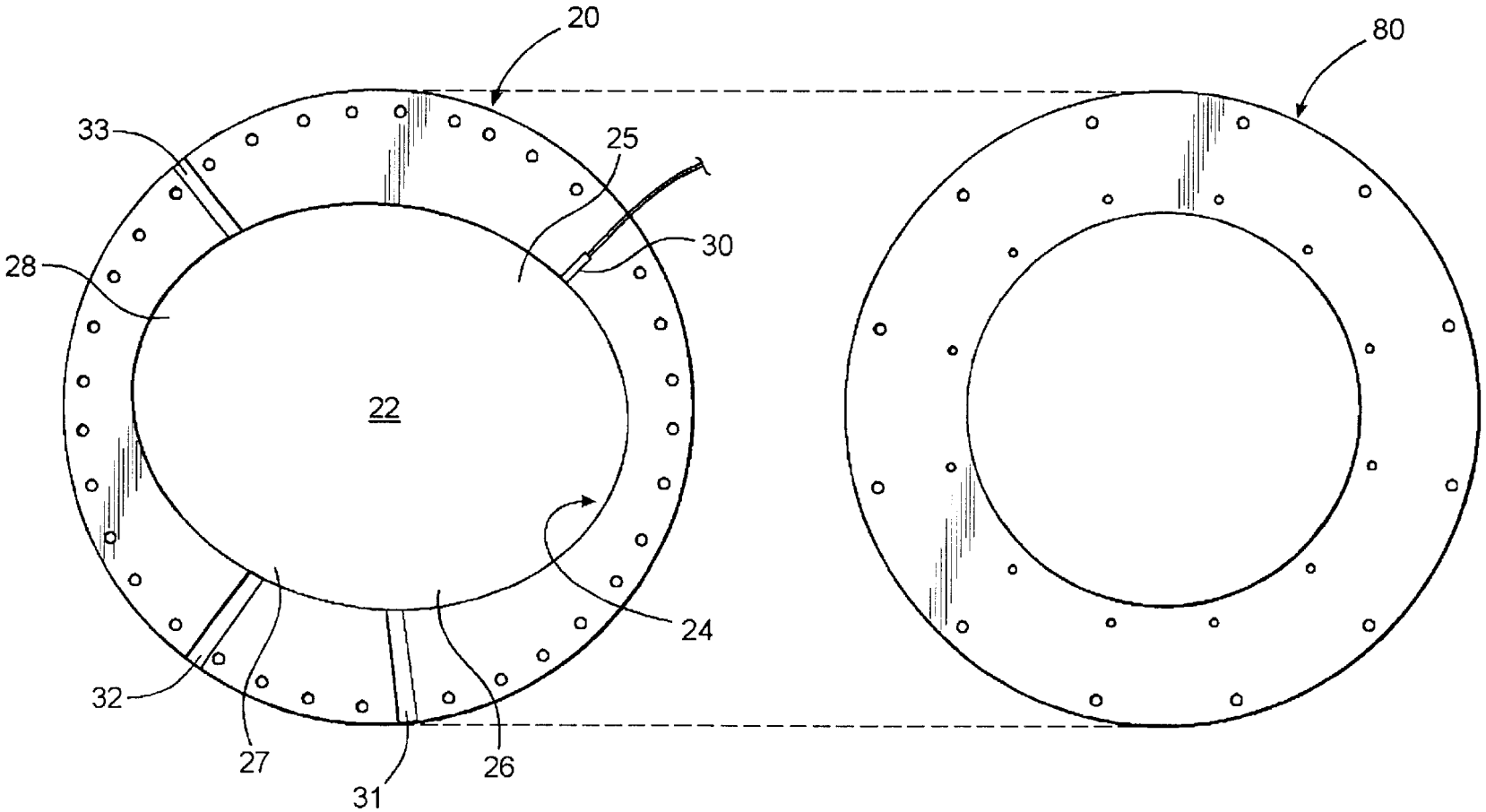
FIG. 4 is a side plan view of the drive chamber of the rotary engine of the present invention.
FIG. 5 is an interior, side plan view of an exterior side panel of the enclosure assembly of the rotary engine of the present invention.

Referring first to FIGS. 1 and 4, the rotary engine 10 of the present invention includes at least one drive chamber, generally 20. The drive chamber 20 is preferably formed of a strong, durable construction, and will be sized to correspond to the application and power output required by the ultimate use of the rotary engine 10. Included in the drive chamber 20 is an interior wall structure 24. The interior wall structure 24 is configured to generally define an at least partially open interior 22 of the drive chamber 20. In this regard, the interior wall structure 24 may have a depth which, as previously is recited, can vary depending upon the output needs of the rotary engine 10. Moreover, as will be described in greater detail subsequently, the interior wall structure 24 of the drive chamber 20 is preferably contoured, at least about a portion thereof. As best seen in FIG. 4, the interior wall structure 24 includes a preferred, generally rounded contour, however, that rounded contour is preferably not completely symmetrical, but rather includes one or more flattened or shallower portions defining the perimeter contour.

Figure 2:
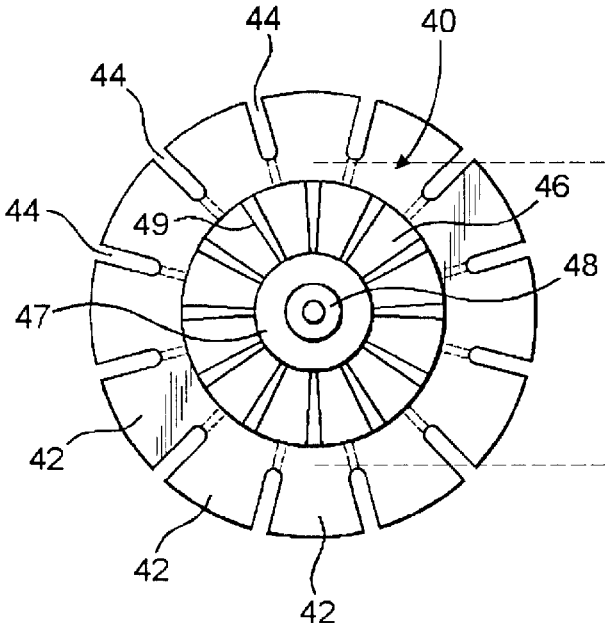
FIG. 2 is an isolated, side plan view of the drive element of the rotary engine of the present invention.
Figure 6:
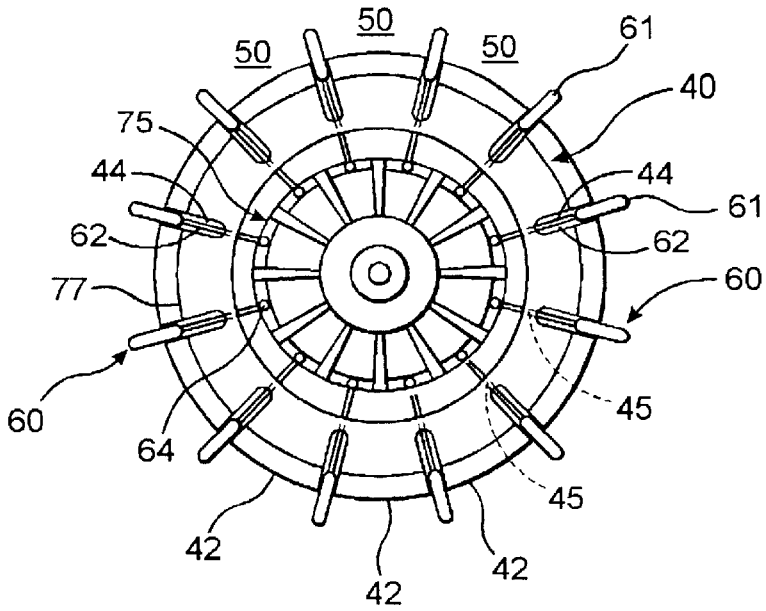
FIG. 6 is an isolated, detailed plan view of the drive element of the present invention including the plurality of fin elements operatively disposed therein.

Rotatably disposed relative to the drive chamber 20 is a drive element 40, best seen in FIGS. 2 and 6. The drive element 40 preferably includes a generally circular configuration and is structured to be disposed within the open interior 22 of the drive chamber 20. Furthermore, the drive element 40 is preferably rotatably disposed about a fixed axis, at which point a rotating central shaft 48, which can serve as the power take-off, is disposed.

Defined about a periphery of the drive element 40 are a plurality of combustion segments 42. These combustion segments 42 preferably extend completely about and define the periphery of the drive element 40, and in the illustrated embodiment are at least partially set apart by a series of channels 44. As best seen in FIG. 2, the channels 44 are preferably, but not necessarily, uniformly spaced from one another so as to define uniform sized combustion segments 42 about the periphery of the drive element 40. Further, it is noted that the depth of these individual channels 44 can vary depending upon the specific design configurations of the rotary engine 10, and/or a dimension of the fin elements 60, which will be described in greater detail subsequently.

As indicated, the drive element 40 is structured to rotate preferably about the fixed axis within the open interior 22 of the drive chamber 20. As a result, the drive element preferably includes a hub 47 type configuration which provides for a certain degree of reinforcement about the central shaft 48 that defines the rotational axis of the drive element 40. Defined preferably about this hub 47, however, is an at least partially open axial region 46. In particular, the axial region 46 is preferably defined between exterior portions of the drive element 40, such as at the location of the combustion segments 42, and is configured so as to contain a quantity of a lubricant fluid therein. The lubricant fluid may be any conventional lubricant which is structured to be cycled and/or circulated through the axial region 46 so as to provide continuous lubrication for the rotation of the drive element 40 and the movement of internal components. Along these lines, a series of spokes 49 are preferably configured to extend from the hub 47 to the perimeter regions of the drive element 40, thereby substantially preserving the open nature of the axial region 46, while providing a substantially secure and stable configuration. In this regard, it is also preferred that the spokes 49 be dimensioned with a sufficient thickness and depth so as provide for effective interconnection, however, they are also preferably configured, either through tapering and/or through the utilization of openings, so as to effectively permit a degree of circulation of the lubricant fluid.

Figure 3:
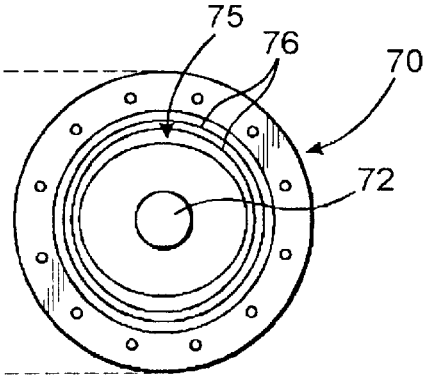
FIG. 3 is an isolated, interior plan view of a central side panel of the enclosure assembly of the rotary engine of the present invention.

In order to effectively contain the lubricant fluid within the axial region 46 of the drive element 40, the present invention also includes an enclosure assembly. The enclosure assembly includes at least one side panel, and in the illustrated embodiment includes a plurality of side panels. For example, as illustrated in FIG. 3, a central side panel 70 is depicted. The central side panel 70 is structured to be disposed in confronting, sealing engagement with the drive element 40 so as to essentially cap off a front or rear face of the axial region 46. For example, as the drive element 40 will generally have a certain depth, that depth depending upon the capacity requirements and dimensional requirements of the rotary type engine 10, the drive element 40 will include front and rear faces. As a result, a portion of the enclosure assembly, such as a central side panel 70, will preferably be disposed in covering relation to the axial region 46 at both the front and rear faces. Of course, for purposes of clarity, only one such face of the drive element 40 is depicted. Also as shown in FIG. 3, one or more gasket assemblies 76 are preferably provided so as to ensure a substantially fluid impervious seal when the central side panel 70 is disposed in confronting relation to the drive element 40, while still permitting the drive element 40 to rotate relative thereto. Likewise, a central opening 72 is preferably provided in at least one of the central side panels 70 so as to permit the central shaft 48 to pass therethrough and freely rotate for power take off purposes. A substantially fluid impervious relationship is also provided between the central shaft 48 and the central side panel 70, with the entire fluid impervious engagement being such as to permit rotation of the drive element 40, as required.

Figure 7:
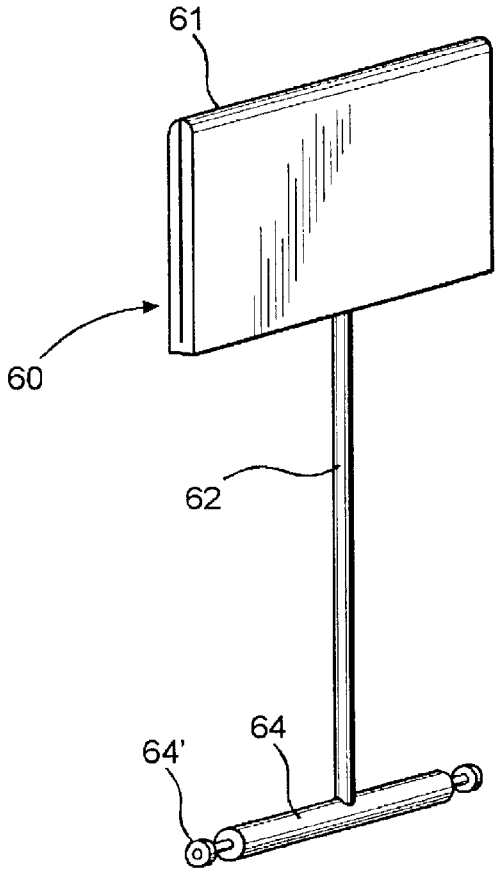
FIG. 7 is an isolated perspective view of a fin element of the present invention.

Extending preferably, but not necessarily from between each adjacent pair of combustion segments 42 is at least one fin element 60. The fin elements 60 preferably extend from within each of the channels 44 and are structured to move radially from the drive element 40. In particular, the fin elements 60 are preferably disposed relative to the drive element 40 such that the amount of radial extension for each fin element 60 is variable, as the fin elements 60 extend more or less from the channels 44. Turning to FIG. 7, each fin element 60 also includes a connector segment 62 operatively coupled thereto. The connector segment 62 is preferably an elongate rod type element which is structured to extend through the drive element 40 and into the axial region 46 of the drive element 40. For example, each channel 44 defined in the periphery of the drive element 40 includes an opening 45 generally at the base thereof which is sized to receive the connector segment 62 movably therein. A gasket or other seal may be provided so as to provide sliding movement of the connector segment 62 through the opening 45, while also providing a substantially fluid impervious seal. Whether or not a seal is provided, however, reciprocal movement of the connector segments 62 through the opening 45 in a radial direction and into and out of the channels 44 provides for effective extension of the fin element 60 a variable, radial distance from the periphery of the drive element 40. In this regard, it is noted that the fin elements 60 preferably include a configuration which facilitates its movable engagement with the interior walls of the corresponding channel 44. As a result, the fin elements 60 and connector segments 62 are perfectly configured such that each fin element 60 can be substantially withdrawn into a corresponding channel 44, and indeed may even be completely drawn into the channel 44 in some embodiments. Conversely, the fin elements 60 are also preferably configured such that upon extension a maximum distance from the channel 44, a base of each of the fin elements 60 preferably remain within the channel 44 at all times. As a result, the resilient nature of the fin elements 60 engaging the interior walls of the channels 44 help to further facilitate a fluid impervious seal such that if lubricant fluid from the axial region 46 passes into the channel 44, it cannot generally escape from the channel 44 into the open interior 22 of the drive chamber 20. Along these lines, a gasket type seal 77 may also be provided at the front and rear faces of the drive element 40 between each of the adjacent channels 44 so as to effectively provide fluid impervious engagement with the enclosure assembly.

As previously indicated, the enclosure assembly includes at least one, but as in the illustrated embodiment, preferably a plurality of side panels. In the illustrated embodiment, an exterior side panel 80, best seen in FIG. 5, is also preferably provided to work in conjunction with one or more central side panels 70. The exterior side panels 80 are structured to generally enclose and contain the drive element 40 within the open interior 22 of the drive chamber 20. In this regard, preferably front and rear exterior side panels 80 are provided at the front and rear faces of the rotary engine 10. In the illustrated embodiment, the exterior side panel 80 is preferably secured, such as by screws, bolts, rivets, welding, clips, clamps, adhesive, etc. to the drive chamber 20, thereby preferably achieving a generally fluid impervious containment of the open interior 22 of the drive chamber 20, while also providing for free rotation of the drive element 40. Along these lines, a central opening 22 is preferably defined in at least one of the exterior side panels 80. The opening 82 being structured to allow exterior access to the central shaft 48 of the drive element, such as through the central side panel 70. In this regard, it is noted that exterior access to the central shaft 48 may only be required at either the front or rear face of the rotary engine 10, such that in an alternate embodiments a single side panel and/or a completely enclosed exterior side panel 80 may be provided at one of the faces of the rotary engine 10. Furthermore, so as to maintain the central side panel 70 in a preferred fixed orientation during rotation of the drive element 40, the central and exterior side panels 70 and 80 are preferably secured to one another by any conventional means. Along these lines, the opening 82, if included can be of any desired size so as to accommodate passage of the central shaft 48.

Turning now to FIGS. 1 and 6, when the drive element 40 is rotatably disposed within the open interior 22 of the drive chamber 20, a plurality of combustion chambers, generally included as 50, are defined. These combustion chambers 50 are preferably defined between at least one of the combustion segments 42 and a corresponding confronting portion of the interior wall structure 24 of the drive chamber 20. As a result, the interior wall structure 24 of the drive chamber 20 provides an exterior dimension to the combustion chambers 50, while a surface of the combustion segments 42 provide an interior perimeter dimensioned to the combustion segments 50. Furthermore, the fin elements 60, which as indicated preferably extend from between each adjacent pair of combustion segments 42, generally define the leading and trailing edges of the combustion chambers 50.

The combustion chambers 50 are structured to define the areas wherein the combustion process will generally take place within the rotary engine 10. As a result of the nature of the rotary engine 10, the combustion cycles are continuously on-going, with each combustion chamber 50 exhibiting a certain phase of the entire combustion cycle at a time followed by a trailing combustion chamber 50. In particular, as previously mentioned, the interior wall structure 24 of the drive chamber 20 preferably includes a generally asymmetrical contour. In the preferred embodiment, it is the configuration of that asymmetrical contour of the interior wall structure 24 relative to the periphery or preferred combustion segments 42 of the drive element 40 which functions primarily to define and vary a size and dimension of the plurality of combustion chambers 50. For example, when a particular combustion segment 42 is disposed in confronting proximity to a flattened or more shallow region of the interior wall structure 24, a preferred generally closer relative spacing therebetween will be exhibited, thereby providing a reduced size combustion chamber 50. In this regard, it is noted that modifying the present invention such that a generally asymmetrical periphery is defined for the drive element, the drive chamber having a more symmetrical configuration and/or also an asymmetrical configuration and rotating relative thereto could also be provided. Likewise, the peripheral configuration of the drive element need not be perfectly symmetrical as a corresponding asymmetrical configuration may also be employed. However, in the illustrated embodiment, it is preferred that the drive element 40 include a generally symmetrical peripheral contour, while the asymmetrical contour is defined at the interior wall structure 24 of the drive chamber 20.

With reference to FIG. 4, the open interior 22, and in particular the interior wall structure 24 of the drive chamber 20, preferably includes a plurality of regions. In the illustrated embodiment, the drive chamber 20 includes a fluid intake region 27, a fuel intake region 28, a combustion region 25, and an exhaust region 26. Furthermore, with regard to these regions, they are indicative of a general area within the drive chamber 20, however, the specific area to be encompassed by each of these regions may vary and indeed a certain amount of overlap or spacing is contemplated, the definition of the regions being provided for the purposes of clarity to denote certain areas of the drive chamber 20. Moreover, for purposes of a clear description of the present invention, the following description is made with reference to a complete single combustion cycle. Additionally, a complete single combustion cycle, for the purposes of clarity, begins with the intake of a combustion aiding fluid, such as air, followed by the intake of the fuel, the subsequent combustion of the fuel/fluid mixture, and finally the evacuation of the combusted exhaust gases. Because of the rotating nature of the combustion chambers 50, however, each of these phases will be going on at substantially all times with respect to different combustion chambers 50.

Looking first to the fluid intake region 27, it preferably includes at least one fluid intake port 32 disposed in fluid flow communication with the open interior 22 of the drive chamber 20. The at least one fluid intake port 32 is structured to direct the fluid, which as indicated is preferably air, into at least one correspondingly disposed combustion chamber 50. As illustrated in the Figures, a single fluid inlet port 32 is provided, however, it is contemplated that more than one, or a larger fluid intake port 32 could be provided so as to introduce fluid simultaneously and/or sequentially into one or more combustion chambers 50 in any desired volume. In either instance, however, the fluid intake port 32 is positioned such that the fluid passes therethrough and enters the contained combustion chamber 50 that is presently in operative communication therewith, and which is enclosed at its leading and trailing edges by the fin elements 60, at an outer perimeter by the interior wall structure 24 of the drive chamber 20, at an interior perimeter by the periphery of the drive element 40, and at its front and rear faces by the enclosure assembly. Of course, it is also noted that one or more liner type materials may be equivalently positioned to define the exact boundaries of the combustion chambers 50 in accordance with the contours of the various components.

With reference to the contour of the interior wall structure 24, it is preferably defined such that a size of the correspondingly disposed combustion chambers 50 will at least temporarily increase as the combustion chambers 50 rotate through the fluid intake region 27. As a result, an intake of fluid can be maximized into the combustion chambers 50. By way of example, the transition region generally between the exhaust region 26 and fluid intake region 27 preferably includes a shallow or generally flattened configuration, for reasons to be described subsequently. A more rounded configuration generally proceeds, presuming a clockwise rotation, as the combustion chambers 50 rotate through the fluid intake region 27. As a result, the combustion chambers begin relatively small and are gradually increasing in size as they rotate through the fluid intake region 27. Along these lines, it is noted that the fluid intake port 32 may be disposed at any general point therealong, the illustrated embodiment providing for fluid intake as the combustion chambers begin to increase, although positioning at a point where the dimension of the combustion chambers is already maximized or has already increased could also be equivalently utilized. Further, it is seen that the dimension temporarily increases, as a more uniform configuration can begin at virtually any point throughout the fluid intake region 27 once an acceptable size for the combustion chambers 50 has been attained, including a more abrupt, stepped type configuration.

As the individual combustion chambers 50 rotate from the fluid intake region 27 they eventually proceed into the fuel intake region 28. In particular, the fuel intake region 28 includes a least one fuel intake port 33 defined in fluid flow communication with the open interior 22 of the drive chamber 20 at one or more points within the fuel intake region 28. The fuel intake port 33 is structured to direct the fuel, preferably a gas, or disbursed liquid type fuel, into correspondingly positioned combustion chambers 50. Also in this regard, multiple or varying sized fuel inlet ports 33 may be provided depending upon the capacity needs of the rotary engine 10 and/or the rotation speed of the drive element 40. At the fuel intake region, the interior wall structured 24 of the drive chamber 20 is preferably configured such that the size of correspondingly disposed combustion chambers 50 will generally decrease as the combustion chambers 50 rotate into and through the fuel intake region 28. In this regard, it is also seen that a transition area between the fuel intake region 28 and the to be described combustion region 25 also includes a flatter or generally shallower configuration, thereby resulting a closer spacing between the interior wall structure 24 and the combustion segments 42 of the drive element 40 when disposed in that portion of the fuel intake region 28. As a result of the at least temporary decrease in the size of the combustion chambers 50 as they enter and/or pass through the combustion region 28, the fuel and air mixture contained within each of the individual combustion chambers 50 tends to be compressed, thereby increasing the overall potential energy which can be exhibited by combustion of the fuel air mixture due both to increased pressure and a higher concentration of the fuel air mixture which can effectuate a more complete burn of substantially all of the fuel.

Turning next to the combustion region 25, at least one combustion ignitor 30 is operatively disposed in communication with at least one of the combustion chambers 50 that is rotating through the combustion region 25. In this regard, the combustion ignitor 30 can take on any of a variety of configurations, including a spark plug or other spark generating device which provides for effective combustion of the fuel-air mixture contained within the combustion chambers 50. Indeed, each individual combustion chamber 50 may include its own independent combustion ignitor, such as operatively disposed within the drive element 40, the primary characteristic being that combustion of the fuel-air mixture takes place at some point within the combustion region 25. Looking to the configuration of the interior wall structure 24, it is preferably defined such that the combustion chambers 50 will at least temporarily increase as they move and proceed through the combustion region 25. In particular, as the surface contour follows clockwise through the combustion region 25, a more rounded configuration is preferably achieved so as to increase the spacing between the interior wall structure 24 and the combustion segments 42 of the combustion element 40. As a result of this generally increasing size of the combustion chambers 50, the ignited fuel air mixture is allowed to fully expand, thereby taking advantage of the driving and rotating energy caused by the expanding fuel air mixture, and indeed, the increase in size also functions to accommodate the expansion of the combusted fuel air mixture. It is preferably at this point in the combustion region 25 wherein the driving expansion of gases occurs which provides an impacting energy on a leading fin element 60 and provides for the rotational driving of the drive element 40. Moreover, as the combustion was preferably initiated when the combustion chambers 50 have a relatively compressed size, most if not all of the fuel is effectively burned, and a highly concentrated combustion "explosion" occurs.

Naturally, when combustion has occurred, as the combustion chambers 50 preferably are substantially enclosed, a quantity of exhaust gases generated by the combusted fluids are contained within the individual combustion chambers 50. It is therefore preferred that these exhaust gases not be present within the combustion chambers 50 as the cycle begins anew. Indeed, one primary drawback associated with prior art devices is the substantially inefficient and incomplete evacuation of these exhaust gases, which results in the mixture of air with these exhaust gases for later mixing with the fuel. Of course, such a contaminated fuel-air mixture, does not provide as effective a burn, and can indeed increase a general toxicity of the exhaust gases as they are subjected to a secondary combustion cycle. In order to avoid such contamination of the fuel air mixture, the present invention also provides at least one exhaust port 31 disposed in fluid flow communication with the open interior 22 of the drive chamber 20 generally at the exhaust region 26. The exhaust port is positioned so as to direct exhaust gases out of at least one correspondingly positioned combustion chamber 50 passing through this region. In particular, the interior wall structure 24 of the drive chamber 20 is preferably configured to begin its flatter and/or shallower configuration as the combustion chambers 50 rotate into and through the exhaust region 26. As a result of this configuration, the relative spacing between the periphery of the drive element 40 and the interior wall structure 24 is reduced and the overall size of the individual combustion chambers 50 is reduced. This general reduction in the size of the combustion 12 chambers 50 provides for a compression of the exhaust gases, but more significantly for the exhaust gases to essentially be pushed out of the at least one exhaust port 31. In this regard, it is actually preferred that an overall size of the combustion chambers 50 and they pass through the exhaust region 26 be at least temporarily minimized to a vary small dimension such that substantially all, if not all, of the exhaust gases are essentially forced and expelled from the combustion chambers 50. Along these lines, a plurality of exhaust ports 31 may be provided sequentially so as to gradually provide for the entire evacuation of the exhaust gases prior to the combustion chambers 50 entering the fluid intake region wherein the air will be introduced.

From the proceeding it can be seen, that a much more efficient cycle can be achieved because of the minimization of contamination within the fuel air mixture, the maximization of the combustion and expansion of ignited fuel, and the maximization of the utilization of all fuels due to the containment and compression of the fuel air mixture at the time of combustion, thereby minimizing fuel waste and reducing the expulsion of unburned hydrocarbons from the system.

Looking now in further details to FIGS. 1 and 6, it is noted that the fin elements 60 of the present invention are configured to extend variably, radially from the drive element 40 in accordance with the interior surface contour of the interior wall structure 24 of the drive chamber 20 so as to effectively maintain containment of the individual combustion chambers 50. For example, during portions of a combustion cycle wherein the dimension of the combustion chambers 50 is minimized, and the spacing between the drive element 40 and the interior wall structure 24 is also reduced, the individual fin elements 60 are substantially retracted into the channels 44, still, however, maintaining a general engagement with the interior wall structure 24. Conversely, however, when the dimension of the combustion chambers 50 is increasing and/or is maximized, the amount which the individual fin elements 60 extend from the drive element 40 is also increased, thereby maintaining that effective engagement. Along these lines, each of the fin elements 60 preferably includes a contact edge 61, at an outermost edge thereof. The contact edge 61 is structured to be maintained substantially continuously in substantially engaging contact with the interior wall structure 24 of the drive chamber 20 so as to maintain a substantially fluid impervious engagement and function to effectively contain the combustion chambers 50 during the entire combustion cycle. As a result, although the interior contour of the drive chamber as defined by the interior wall structure 24 may vary, it is preferably still a generally smooth continuous contour so as to permit continuous riding engagement of the contact edges 61 of the fin elements 60 as they rotate through the combustion chamber 20 with the drive element 40.

In order to maintain the substantially continuous, substantially fluid impervious engagement between the contact edges 61 of the fin elements 60 with the interior wall structure 24 of the drive chamber 20, the present invention also preferably includes a guide assembly. In particular, although it is noticed that the natural compression which may result from a reduction in spacing between the drive element 40 and the interior wall structure 24, preferably in conjunction with a biasing element may also function to vary the amount which the fin elements 60 extend from the drive element 40, in at least one preferred embodiment, a more affirmative guidance and control over the extension of the fin elements 60 be maintained. As a result, the guide assembly is structured to substantially correspond the contour of the interior wall structure 24 of the drive chamber so as to somewhat precisely extend the fin elements 60 a corresponding amount from the drive element 40. Of course, a combination of biasing elements and the to be recited guide assembly may also be utilized.

Looking to the preferred guide assembly of the illustrated embodiment of FIGS. 3 and 6, a guide track 75 is preferably provided. This guide track 75 may be disposed in operative and/or direct engagement with the drive element 40, or as in the illustrated embodiment may be positioned on one or both of the central side panels 70. The guide track 75 preferably includes a contour which substantially matches the contour of the interior wall structure 24 of the drive chamber 20. Furthermore, operatively associated with each of the connector segments 62 of the fin elements 60 are preferably a plurality of engagement elements 64. The engagement elements 64, each of which preferably includes at least one rotatable bearing 64', are structured to engage and indeed ride within the guide track 75 of the illustrated embodiment. As a result, as the drive element 40 generally rotates relative to the central side panel 70, the engagement element 64 is generally retained within the guide track 75, and a resulting radial movement of the fin elements 60 proceeds. Of course, the specific configuration of the guide track 75 and the engagement elements 64 may vary, such as by the positioning of a plurality of rotating bearings on the central side panel 70, with a track type structure on the engagement element 64. In either embodiment, however, the guide assembly generally provides for effective variable positioning of the fin element 60 in accordance with the contour of the interior wall structure 24, and effective containment of the integrity of the individual combustion chambers 50 is maintained, even as the combustion chambers 50 vary in dimension.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A rotary engine comprising:

a) at least one drive element;

b) at least one drive chamber, said drive chamber including an interior wall structure which defines an at least partially open interior;

c) said drive element disposed within said open interior of said drive chamber, said drive chamber and said interior wall structure of said drive element structured to rotate relative to one another;

d) a plurality of combustion chambers defined about a periphery of said drive element, said combustion chambers being structured to be variably sized and be movably disposed within said open interior in response to said relative rotation between said drive element and said interior wall structure of said drive chamber;

e) a guide assembly comprising a guide track structured to correspond to a relative spacing between said interior wall structure and said periphery of said drive element;

f) a plurality of fin elements disposed between said combustion segments and movably mounted on said drive element and rotatable therewith; each of said fin elements including an engagement element attached thereto and a connecting segment secured in interconnecting relation between said engagement element and said fin element; and g) said connecting segment comprising an elongated rod of lesser transverse dimension than said fin element and said engagement element oriented perpendicular to said rod at an opposite end thereof relative to said fin element; said engagement element including at least one bearing member mounted thereon and disposed to facilitate movement of said engagement element along said guide track.

2. A rotary engine as recited in claim 1 further comprising said plurality of fin elements extending radially outward from a periphery of said drive element and structured to move relative to said interior wall of said drive chamber upon relative rotation between said drive chamber and said interior wall structure of said drive element; each of said fin elements including a contact edge structured to be disposed in substantially fluid impervious relation with said interior wall structure of said drive chamber.

3. A rotary engine as recited in claim 1 wherein said drive element comprises a plurality of channels disposed in spaced relation to one another, each of said channels dimensioned and configured to slidingly and reciprocally receive one of said fin elements therein.

4. A rotary engine as recited in claim 3 wherein each of said channels includes a base portion having an opening extending there through, said opening dimensioned and configured to reciprocally receive said connecting segment of a different one of said fin elements therein.

5. A rotary engine as recited in claim 4 further comprising a seal connected adjacent said opening in said base of each of said channels, said seal slidingly engaging a corresponding one of said connecting segments so as to define a substantially fluid impervious engagement there between.

6. A rotary engine as recited in claim 1 wherein said drive element includes an at least partially open axial region.

7. A rotary engine as recited in claim 6 wherein said connector sement extends at least partially axially through said drive element into said axial region of said drive element.

8. A rotary engine as recited in claim 6 further comprising an enclosure assembly structured to enclose said drive element within said open interior of said drive chamber, to enclose open sides of each of said combustion chambers, and to enclose said axial region of said drive element.

9. A rotary engine as recited in claim 8 wherein said guide assembly is cooperatively disposed between each of said fin elements and at least part of said enclosure structure.

10. A rotary engine as recited in claim 8 wherein said enclosure assembly includes at least one side panel disposed in confronting relation with said drive element, said guide track being connected to said side panel.

11. A rotary engine comprising:

a) at least one drive element;

b) at least one drive chamber, said drive chamber including an interior wall structure which at least partially defines an at least partially open interior;

c) said drive element being rotatably disposed within said open interior of said drive chamber about a fixed axis;

d) a plurality of combustion segments at least partially defining a periphery of said drive element;

e) a plurality of combustion chambers, at least one of said combustion chambers defined at each of said combustion segments;

f) said combustion chambers being movably disposed, with a corresponding one of said combustion segments, relative to said interior wall structure of said drive chamber in response to rotation of said drive element;

g) said combustion chambers being at least partially sized in accordance with a relative spacing between said combustion segments and said interior wall structure of said drive chamber;

h) said interior wall structure of said drive chamber and said combustion segments being relatively disposed and configured to vary the size of said combustion chambers during rotation of said drive element;

i) a guide assembly comprising a guide track structured to correspond to a relative spacing between said interior wall structure and said periphery of said drive element;

j) a plurality of fin elements disposed between said combustion segments and movably mounted on said drive element and rotatable therewith; each of said fin elements including an engagement element attached thereto and a connecting segment secured in interconnecting relation between said engagement element and said fin element; and k) said connecting segment comprising an elongated rod of lesser transverse dimension than said fin element and said engagement element oriented perpendicular to said rod and at an opposite end thereof relative to said fin element; said engagement element including at least one bearing member mounted thereon and disposed to facilitate movement of said engagement element along said guide track.

12. A rotary engine as recited in claim 11 further comprising an enclosure assembly structured to enclose said drive element within said open interior of said drive chamber, and to enclose open sides of each of said combustion chambers.

13. A rotary engine as recited in claim 12 wherein said enclosure assembly includes at least one side panel disposed in confronting relation with said drive element.

14. A rotary engine as recited in claim 11 wherein said open interior of said drive chamber includes at least a fuel intake region.

15. A rotary engine as recited in claim 14 wherein said interior wall structure of said drive chamber is structured to be in closely spaced proximity to confronting ones of said combustion segments at least along a portion of said fuel intake region so as to minimize a size of correspondingly disposed ones of said combustion chambers.

16. A rotary engine as recited in claim 14 wherein said is interior wall structure is defined such that said size of said correspondingly disposed ones of said combustion chambers at least temporarily decrease as said combustion chambers rotate through said fuel intake region, thereby compressing a fuel contained in said combustion chambers.

17. A rotary engine as recited in claim 16 further comprising at least fuel inlet port disposed in fluid flow communication with said open interior of said drive chamber at said fuel intake region so as to direct said fuel into at least one correspondingly disposed combustion chamber.

18. A rotary engine as recited in claim 11 wherein said open interior of said drive chamber includes at least a combustion region.

19. A rotary engine as recited in claim 18 wherein said interior wall structure of said drive chamber is structured to be in spaced proximity to confronting ones of said combustion segments at least along a portion of said combustion region so as to maximize said size of correspondingly disposed ones of said combustion chambers.

20. A rotary engine as recited in claim 18 wherein said interior wall structure is defined such that said size of said correspondingly disposed ones of said combustion chambers at least temporarily increase as said combustion chambers rotate through said combustion region, thereby facilitating maximum expansion of combusted fuel in said combustion chambers.

21. A rotary engine as recited in claim 20 further comprising at least one combustion ignitor disposed in operative communication with at least one of said combustion chambers disposed in said combustion region so as to ignite said fuel disposed therein.

22. A rotary engine as recited in claim 11 wherein said open interior of said drive chamber includes at least an exhaust region.

23. A rotary engine as recited in claim 22 wherein said interior wall structure of said drive chamber is structured to be in closely spaced proximity to confronting ones of said combustion segments at least along a portion of said exhaust region so as to minimize said size of correspondingly disposed ones of said combustion chambers.

24. A rotary engine as recited in claim 22 wherein said interior wall structure is defined such that said size of said correspondingly disposed ones of said combustion chambers at least temporarily decrease as said combustion chambers rotate through said exhaust region, thereby maximizing an evacuation of exhaust fluids from said combustion chambers.

25. A rotary engine as recited in claim 24 further comprising at least one exhaust port disposed in fluid flow communication with said open interior of said drive chamber at said exhaust region so as to direct said exhaust fluids out of at least one correspondingly disposed combustion chamber.

26. A rotary engine as recited in claim 11 wherein said open interior of said drive chamber includes at least a fluid intake region.

27. A rotary engine as recited in claim 26 wherein said interior wall structure of said drive chamber is structured to be in spaced proximity to confronting ones of said combustion segments at least along a portion of said fluid intake region so as to maximize said size of correspondingly disposed ones of said combustion chambers.

28. A rotary engine as recited in claim 26 wherein said interior wall structure is defined such that said size of said correspondingly disposed ones of said combustion chambers at least temporarily increase as said combustion chambers rotate through said fluid intake region, thereby maximum an intake of fluid into said combustion chambers.

29. A rotary engine as recited in claim 28 further comprising at least one fluid intake port disposed in fluid flow communication with said open interior of said drive chamber at said fluid intake region so as to direct said fluid into at least one correspondingly disposed combustion chamber.

30. A rotary engine as recited in claim 5 wherein said open interior of said drive chamber includes at least a fluid intake region and an exhaust region.

31. A rotary engine as recited in claim 30 wherein said interior wall structure is defined such that said size of correspondingly disposed ones of said combustion chambers are at least temporarily minimized as said combustion chambers rotate from said exhaust region to said fluid intake region, thereby evacuating substantially all exhaust fluids from said combustion chamber prior to introduction of a fluid therein.

32. A rotary engine as recited in claim 31 further comprising at least one fluid intake port disposed in fluid flow communication with said open interior of said drive chamber at said fluid intake region so as to direct said fluid into at least one correspondingly disposed combustion chamber, and at least one exhaust port disposed in fluid flow communication with said open interior of said drive chamber at said exhaust region so as to direct said exhaust fluids out of at least one correspondingly disposed combustion chamber.

33. A rotary engine as recited in claim 11 wherein said drive element includes an at least partially open axial region.

34. A rotary engine as recited in claim 33 wherein said axial region is structured to contain a quantity of lubrication fluid.

35. A rotary engine as recited in claim 33 further comprising an enclosure assembly structured to enclose said drive element within said open interior of said drive chamber, to enclose open sides of each of said combustion chambers, and to enclose said axial region in a substantially fluid impervious manner.

36. A rotary engine comprising:

a) at least one drive element;

b) at least one drive chamber, said drive chamber including an interior wall structure which at least partially defines an at least partially open interior;

c) said open interior of said drive chamber including at least a fuel intake region, a combustion region, an exhaust region, and a fluid intake region;

d) said drive element being rotatably disposed within said open interior of said drive chamber about a fixed axis;

e) a plurality of combustion chambers defined about a periphery of said drive element and movably disposed relative to said interior wall structure of said drive chamber in response to rotation of said drive element;

f) said combustion chambers being at least partially sized in accordance with a relative spacing between said periphery of said drive element and said interior wall structure of said drive chamber;

g) said interior wall structure being defined:

(i) such that said size of correspondingly disposed ones of said combustion chambers at least temporarily decrease as said combustion chambers rotate through said fuel intake region, thereby compressing a fuel contained in said combustion chambers;

(ii) such that said size of said correspondingly disposed ones of said combustion chambers at least temporarily increase as said combustion chambers rotate through said combustion region, thereby facilitating maximum expansion of combusted fuel in said combustion chambers;

(iii) such that said size of said correspondingly disposed ones of said combustion chambers at least temporarily decrease as said combustion chambers rotate through said exhaust region, thereby maximizing an evacuation of exhaust fluids from said combustion chambers; and (iv) such that said size of said correspondingly disposed ones of said combustion chambers at least temporarily increase as said combustion chambers rotate through said fluid intake region, thereby maximum an intake of fluid into said combustion chambers; and h) a power take off operatively associated with said drive element, i) a guide assembly comprising a guide track structured to correspond to a relative spacing between said interior wall structure and said periphery of said drive element;

j) a plurality of fin elements disposed between said combustion segments and movably mounted on said drive element and rotatable therewith; each of said fin elements including an engagement element attached thereto and a connecting segment secured in interconnecting relation between said engagement element and said fin element; and k) said connecting segment comprising an elongated rod of lesser transverse dimension than said fin element and said engagement element oriented perpendicular to said rod and at an opposite end thereof relative to said fin element; said engagement element including at least one bearing member mounted thereon and disposed to facilitate movement of said engagement element along said guide track.

37. A rotary engine as recited in claim 39 further comprising at least one fluid intake port disposed in fluid flow communication with said open interior of said drive chamber at said fluid intake region so as to direct said fluid into at least one correspondingly disposed combustion chamber.

38. A rotary engine as recited in claim 37 further comprising at least one combustion ignitor disposed in operative communication with at least one of said combustion chambers disposed in said combustion region so as to ignite said fuel disposed therein.

39. A rotary engine as recited in claim 38 further comprising at least one exhaust port disposed in fluid flow communication with said open interior of said drive chamber at said exhaust region so as to direct said exhaust fluid out of at least one correspondingly disposed combustion chamber.

40. A rotary engine as recited in claim 36 further comprising at least fuel inlet port disposed in fluid flow communication with said open interior of said drive chamber at said fuel intake region so as to direct said fuel into at least one correspondingly disposed combustion chamber.

41. A rotary engine as recited in claim 36 wherein said open interior of said drive chamber includes at least a fuel intake region.

42. A rotary engine as recited in claim 41 wherein said interior wall structure and said drive element are structured relative to one another such that a size of correspondingly disposed ones of said combustion chambers at least temporarily decrease as said combustion chambers rotate through said fuel intake region, thereby compressing a fuel contained in said combustion chambers.

43. A rotary engine as recited in claim 42 wherein said open interior of said drive chamber includes at least a combustion region.

44. A rotary engine as recited in claim 43 wherein said interior wall structure and said drive element are structured relative to one another such that said size of said correspondingly disposed ones of said combustion chambers at least temporarily increase as said combustion chambers rotate through said combustion region, thereby facilitating maximum expansion of combusted fuel in said combustion chambers.

45. A rotary engine as recited in claim 44 wherein said open interior of said drive chamber includes at least an exhaust region.

46. A rotary engine as recited in claim 45 wherein said interior wall structure and said drive element are structured relative to one another such that said size of said correspondingly disposed ones of said combustion chambers at least temporarily decrease as said combustion chambers rotate through said exhaust region, thereby maximizing an evacuation of exhaust fluids from said combustion chambers.

47. A rotary engine as recited in claim 46 wherein said open interior of said drive chamber includes at least a fluid intake region.

48. A rotary engine as recited in claim 47 wherein said interior wall structure and said drive element are structured relative to one another such that said size of said correspondingly disposed ones of said combustion chambers at least temporarily increase as said combustion chambers rotate through said fluid intake region, thereby maximum an intake of fluid into said combustion chambers.

* * * * *